US006968946B2

(12) United States Patent
Shuert

(10) Patent No.: US 6,968,946 B2
(45) Date of Patent: Nov. 29, 2005

(54) BULK CONTAINER WITH PLASTIC LINER

(76) Inventor: Lyle H. Shuert, 70 Kingsley Manor Dr., Bloomfield Hills, MI (US) 48304

( * ) Notice: Subject to any disclaimer, the term of this patent is extended or adjusted under 35 U.S.C. 154(b) by 326 days.

(21) Appl. No.: 10/326,659

(22) Filed: Dec. 19, 2002

(65) Prior Publication Data

US 2004/0118725 A1 Jun. 24, 2004

(51) Int. Cl.[7] ..... B65D 19/00
(52) U.S. Cl. ..... 206/386; 222/185.1; 229/122.2
(58) Field of Search ..... 206/386, 584, 206/594, 595, 597, 804; 222/181.1, 181.2, 222/185.1; 229/109, 117.27, 117.28, 122.1, 229/122.2, 122.3, 122.32, 125.14

(56) References Cited

U.S. PATENT DOCUMENTS

| | | | | |
|---|---|---|---|---|
| 3,433,400 A | * | 3/1969 | Hawkins | 229/109 |
| 3,785,534 A | * | 1/1974 | Smith | 222/460 |
| 4,247,021 A | * | 1/1981 | Renier et al. | 222/143 |
| 4,397,406 A | * | 8/1983 | Croley | 222/105 |
| 4,550,830 A | | 11/1985 | Shuert | 206/386 |
| 4,742,781 A | | 5/1988 | Shuert | 108/55.3 |
| 4,765,252 A | | 8/1988 | Shuert | 108/55.1 |
| 4,817,824 A | * | 4/1989 | LaFleur et al. | 222/105 |
| 4,936,451 A | | 6/1990 | Shuert | 206/386 |
| 4,989,731 A | | 2/1991 | Shuert | 206/386 |
| 5,133,460 A | | 7/1992 | Shuert | 206/600 |
| 5,279,423 A | | 1/1994 | Shuert | 206/600 |
| 5,333,757 A | * | 8/1994 | Volk et al. | 222/94 |
| 5,358,137 A | | 10/1994 | Shuert et al. | 220/401 |
| 5,402,915 A | * | 4/1995 | Hogan | 222/105 |

* cited by examiner

*Primary Examiner*—John A. Ricci
(74) *Attorney, Agent, or Firm*—Young & Basile, P.C.

(57) ABSTRACT

A container including a rigid plastic pallet having a platform portion defining a central discharge port, a tubular cardboard sleeve supported at a lower edge thereof on the pallet, and a flexible plastic liner positioned within the sleeve. The liner includes an upper portion of uniform cross-sectional configuration conforming to the cross-sectional configuration of the sleeve and a lower portion of downwardly and inwardly tapering configuration terminating in a bottom liner opening positioned proximate the pallet discharge port. The effective combined height of the upper and lower portions of the liner, with the upper edge of the upper liner portion secured to the upper edge of the sleeve, is greater than the distance from the upper edge of the sleeve to the upper face of the pallet so that the sides of the lower portion may bulge outwardly in response to the loading of contents into the liner to at least partially fill the annular void defined between the sleeve and the lower portion of the liner with the liner fully extended. The pallet port is selectively closed by a trap door pivotedly mounted on the pallet. The pallet port is selectively closed by a trap door pivotally mounted on the pallet and the liner includes a discharge spout extending downwardly from the lower portion of the liner for passage through the pallet discharge port.

11 Claims, 8 Drawing Sheets

BULK CONTAINER WITH PLASTIC LINER

BACKGROUND OF THE INVENTION

This invention relates to containers and more particularly to containers that are especially suitable for use with bulk materials.

Bulk containers are known wherein the container includes a rigid plastic pallet having a platform portion defining a central discharge port, a tubular sleeve supported in upstanding fashion on the upper face of the pallet, and a flexible plastic liner positioned within the sleeve and including a bottom opening so that bulk material contained within the liner may be selectively discharged from the container by opening the bottom of the liner and discharging the liner contents downwardly through the discharge port in the pallet. Whereas this type of container is generally satisfactory, the discharge of the liner contents is incomplete since large quantities of bulk material remain in the liner in the annular area surrounding the discharge port. In an effort to overcome this problem of retained bulk material, it has been proposed to position annular plastic inserts in the bottom of the sleeve which are configured to define a central conical chute terminating at the discharge port in the pallet. Whereas this arrangement reduces the quantity of retained material in the container, it adds to the cost of the container and the capacity of the container is reduced by the triangulated annular volume of the insert.

SUMMARY OF THE INVENTION

This invention is directed to the provision of an improved bulk container.

More specifically this invention is directed to the provision of a bulk container in which substantially all of the volume of the container may be utilized and substantially all of the contents of the container may be readily discharged.

This invention relates to a container of the type including a pallet having a platform portion defining a central discharge port, a tubular sleeve supported at a lower edge thereof on the pallet, and a flexible liner positioned within the sleeve.

According to the invention, the liner includes an upper portion of uniform cross-sectional configuration conforming to the cross-sectional configuration of the sleeve and a lower portion of downwardly and inwardly tapering configuration terminating at a bottom liner opening positioned proximate the pallet discharge port. This arrangement facilitates the substantially total discharge of the contents of the container.

According to a further feature of the invention, the effective height of the liner within the sleeve with the upper edge of the upper liner portion secured to the upper edge of the sleeve is greater than the distance from the upper edge of the sleeve to the top face of the pallet proximate of the discharge port. With this arrangement, the sides of the lower portion of the liner may bulge outwardly in response to the loading of the contents into the liner to at least partially fill the annular void defined between the sleeve and the lower portion of the liner with the liner fully extended.

According to a further feature of the invention, the liner further includes a spout extending downwardly from the lower end of the lower portion for passage through the pallet discharge port. This arrangement positively directs the liner content through the discharge port, provides a valving means to readily control the discharge process, and provides a mechanism for ensuring the discharge of the final residual contents.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
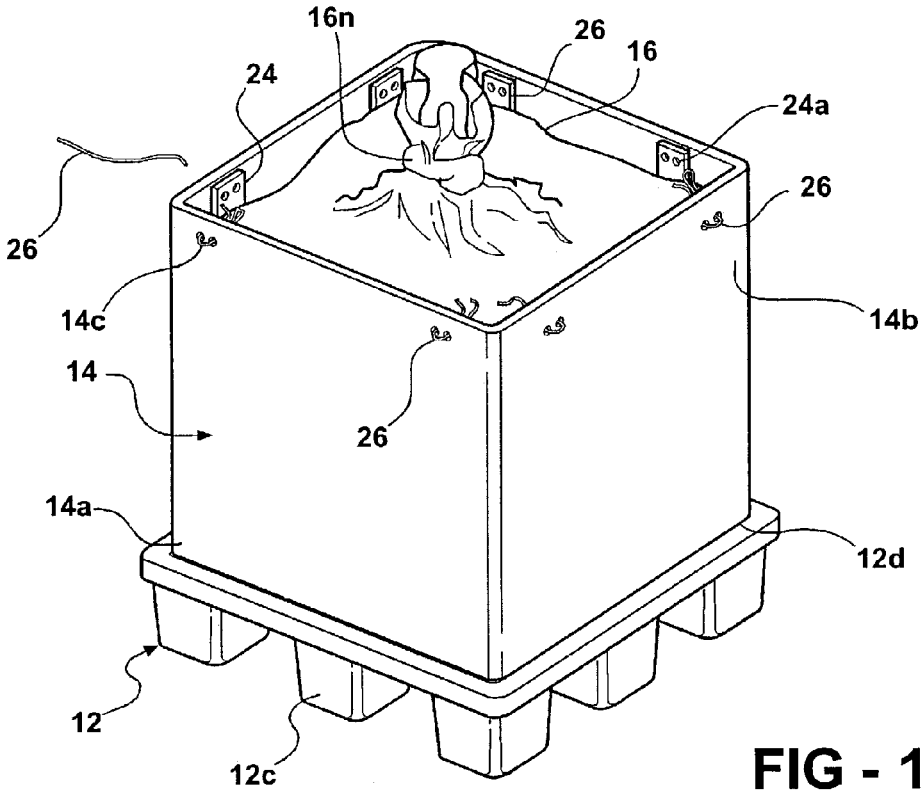
FIG. 1 is a perspective view of a container according to the invention.

The container 10 seen in FIG. 1, broadly considered, includes a rigid plastic pallet 12, a sleeve 14, and a liner 16.

Figure 3:
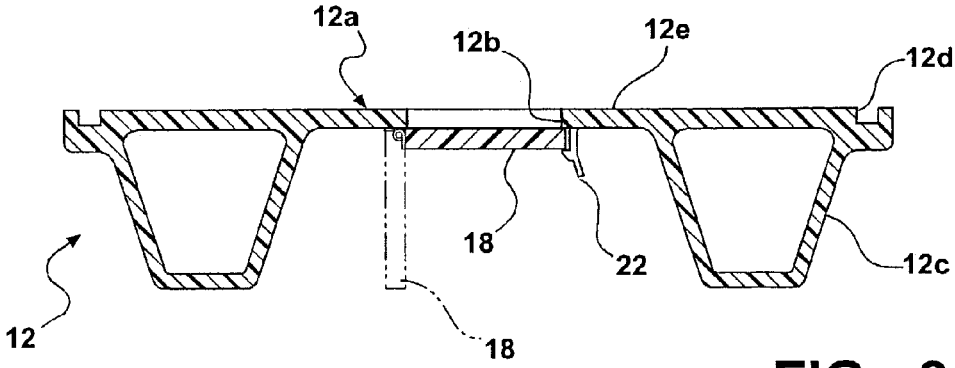
FIG. 3 is a cross-sectional view of the container pallet taken on line 3—3 of FIG. 2.

Pallet 12 has a rectangular configuration and is formed in a molding operation of a rigid plastic material such, for example, as polyethylene. Pallet 12 may be vacuum formed in a twin sheet operation or may, as shown for simplicity, have a single sheet construction. Pallet 12 includes a central platform portion 12*a* defining a central rectangular discharge port 12*b*, and a plurality of down-standing legs 12*c* operative to maintain the platform portion 12*a* in spaced relation to a support surface. An annular upwardly opening rectangular groove 12*d* is defined around the periphery of the platform portion and a trap door 18 is pivotably mounted at pivot point 20 to the under face of the platform portion of the pallet. Trap door 18 is moveable pivotably about pivot point 20 between a closed position seen in solid lines in FIG. 3, in which the port 12*b* is closed, and an open position seen in dash lines in FIG. 3 in which the port 12*b* is open. Suitable latch means 22 maintain the trap door in the closed position and allow release of the trap door for movement to the open position.

Sleeve 14 has a tubular, rectangular configuration and, preferably, is formed of a cardboard material such as a three-ply corrugated material commercially available from Tri-wall Containers, Inc. Sleeve 14 is received at its lower edge 14*a* in pallet groove 12*b* so that the sleeve is supported in upstanding fashion on the pallet.

Liner 16 is formed of a suitable flexible transparent plastic material such for example as polyethylene and includes an upper portion 16*a*, a lower portion 16*b*, a discharge spout portion 16*c*, and a loading portion 16*d*.

Upper portion 16*a* has a uniform cross-sectional configuration throughout the height of the portion conforming to the cross-sectional configuration (for example, rectangular) of the sleeve. Lower portion 16*b* extends downwardly from the lower edge 16*e* of upper portion 16*a* and has a downwardly and inwardly tapering configuration terminating in a lower end 16*f* defining a liner opening 16*g*. Portion 16*b* may, as shown, have a truncated pyramidal configuration or may have a conical configuration.

Figure 4:
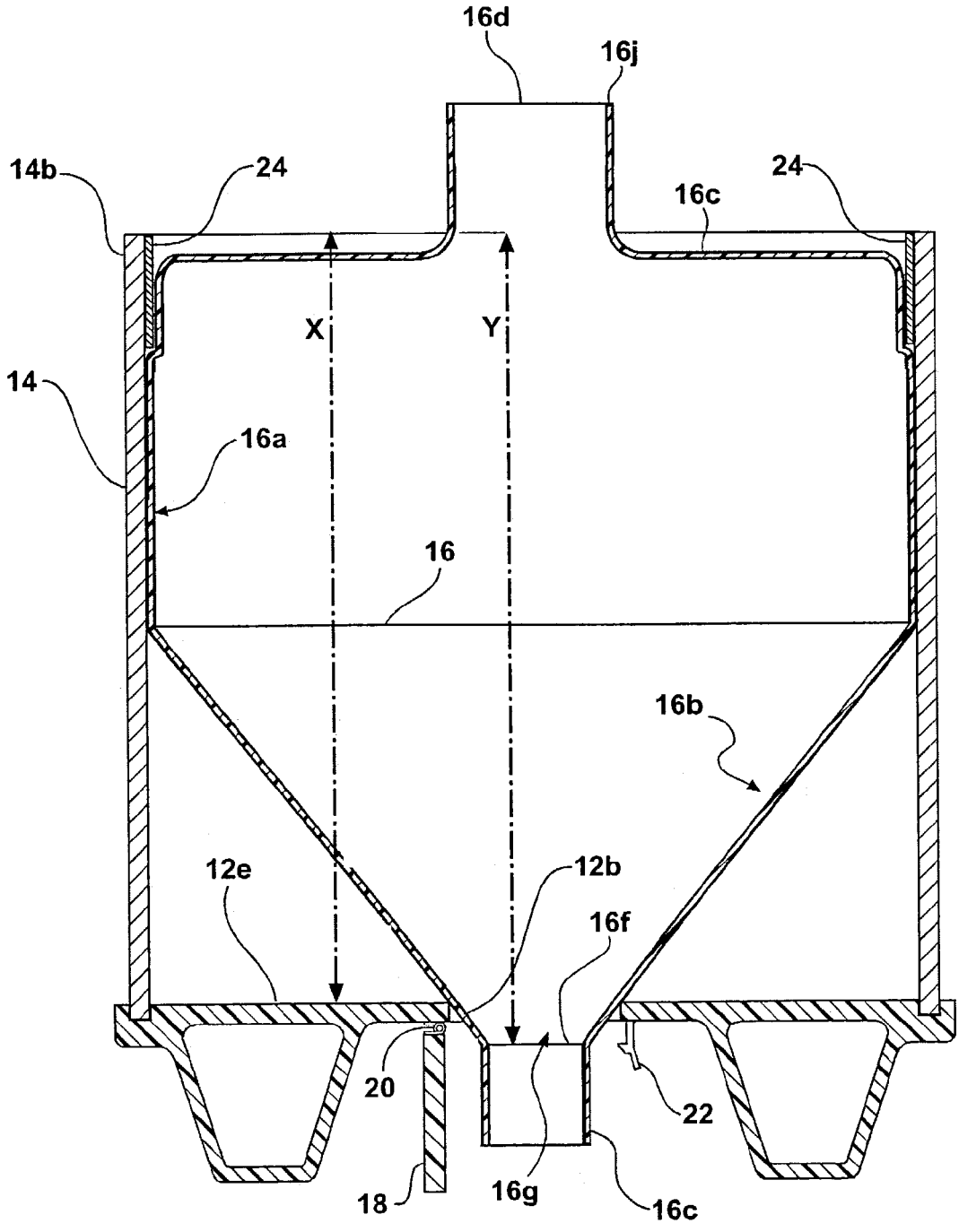
FIG. 4 is a fragmentary somewhat schematic view of the container.

Liner 16 is adapted to fit within sleeve 14 with the upper edge 16*h* of the liner secured to the upper edge 14*b* of the sleeve. For example, and as shown, a plurality of tabs 24 may be adhesively secured to the liner upper edge 16*h* at circumferentially spaced locations and the tabs may include holes 24*a* which may be aligned with holes 14*c* in the sleeve proximate the upper edge 14*b* of the sleeve to receive shoe strings 26 to effectively "tie" the upper edge of the liner to the upper edge of the sleeve. With the upper edge of the upper liner portion secured to the upper edge of the sleeve, the effective height Y of the liner within the sleeve, including the combined height of upper portion 16*a* and lower portion 16*b* and the additional height of tabs 24, is greater than the distance X from the upper edge of the sleeve to the upper face 12*e* of the platform portion 12*a* of the pallet proximate the opening 12*b* so that, as seen in FIG. 4, with the liner extending downwardly in a relaxed configuration within the sleeve and downwardly through the port 12*b*, the lower end 16*f* of lower liner portion 16*b* is positioned significantly below the upper face 12*e* of the pallet platform portion.

Discharge spout portion 16*c* extends downwardly from the lower end of the lower liner portion, has a uniform diameter throughout its height, and may have a rectangular or a circular cross-sectional configuration.

Loading portion 16*d* includes a top 16*i* closing the upper end of upper portion 16*a* and a central loading spout 16*j* extending upwardly from top 16*i*.

Figure 5:
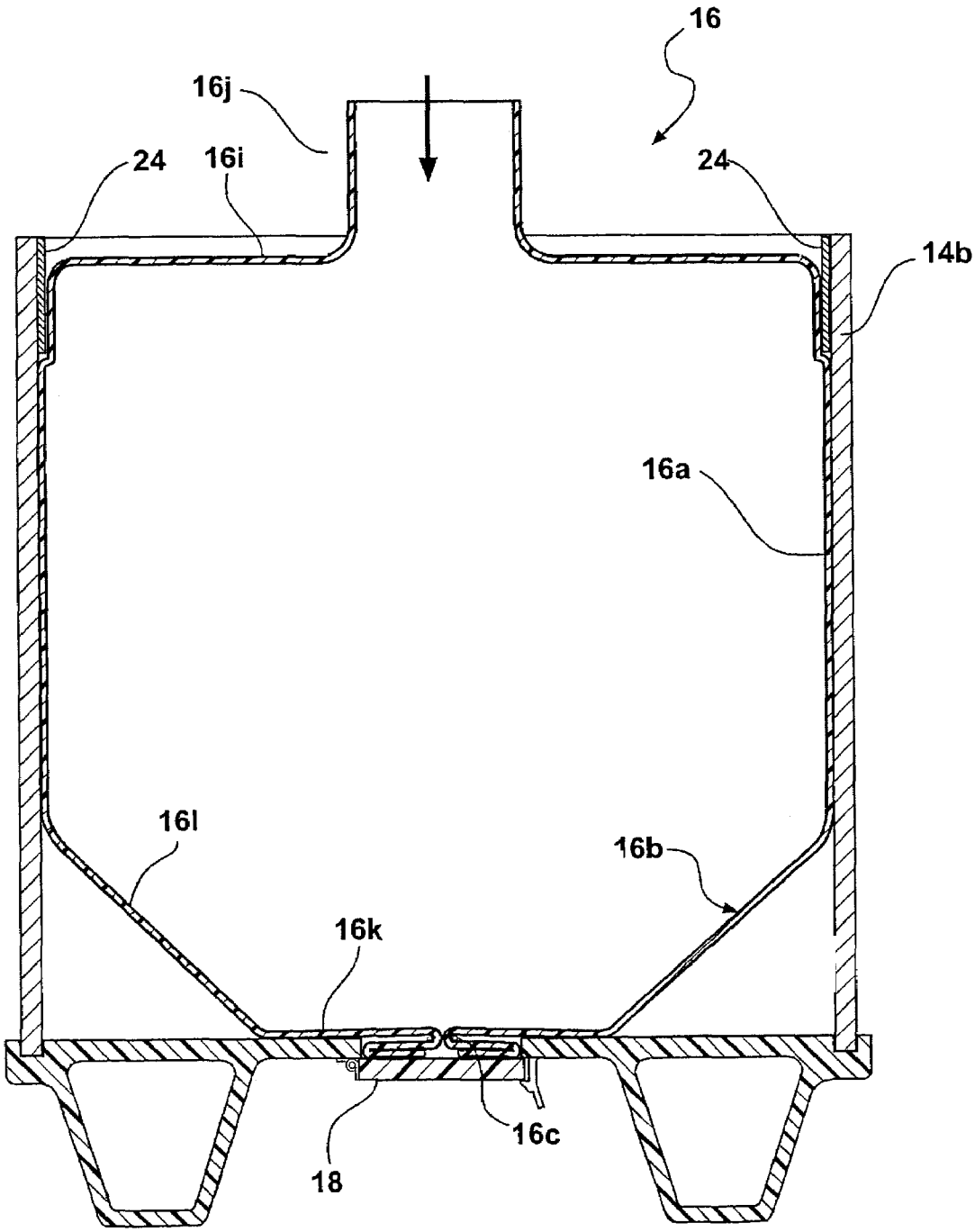
FIGS. 5, 6, 7 and 8 are successive views showing the use of the container.

In use, portion 16*c* is rolled or folded up and suitably secured, such as by tape, to the lower end of the lower portion 16*b* so that, as seen in FIG. 5, the spout may be positioned within the pallet port 12*b* in overlying relation to the closed trap door 18. Since the effective height of the upper and lower portions 16*a* and 16*b* of the liner within the sleeve is greater than the distance from the upper edge of the sleeve to the upper face 12*e* of the platform portion of the pallet, the lower portion of the liner will tend to divide itself between an annular flat portion 16*k* in surrounding relation to the port 12*b* and a truncated pyramidal portion 16*l* extending upwardly from portion 16*k* for joinder to upper portion 16*a*.

Figure 6:
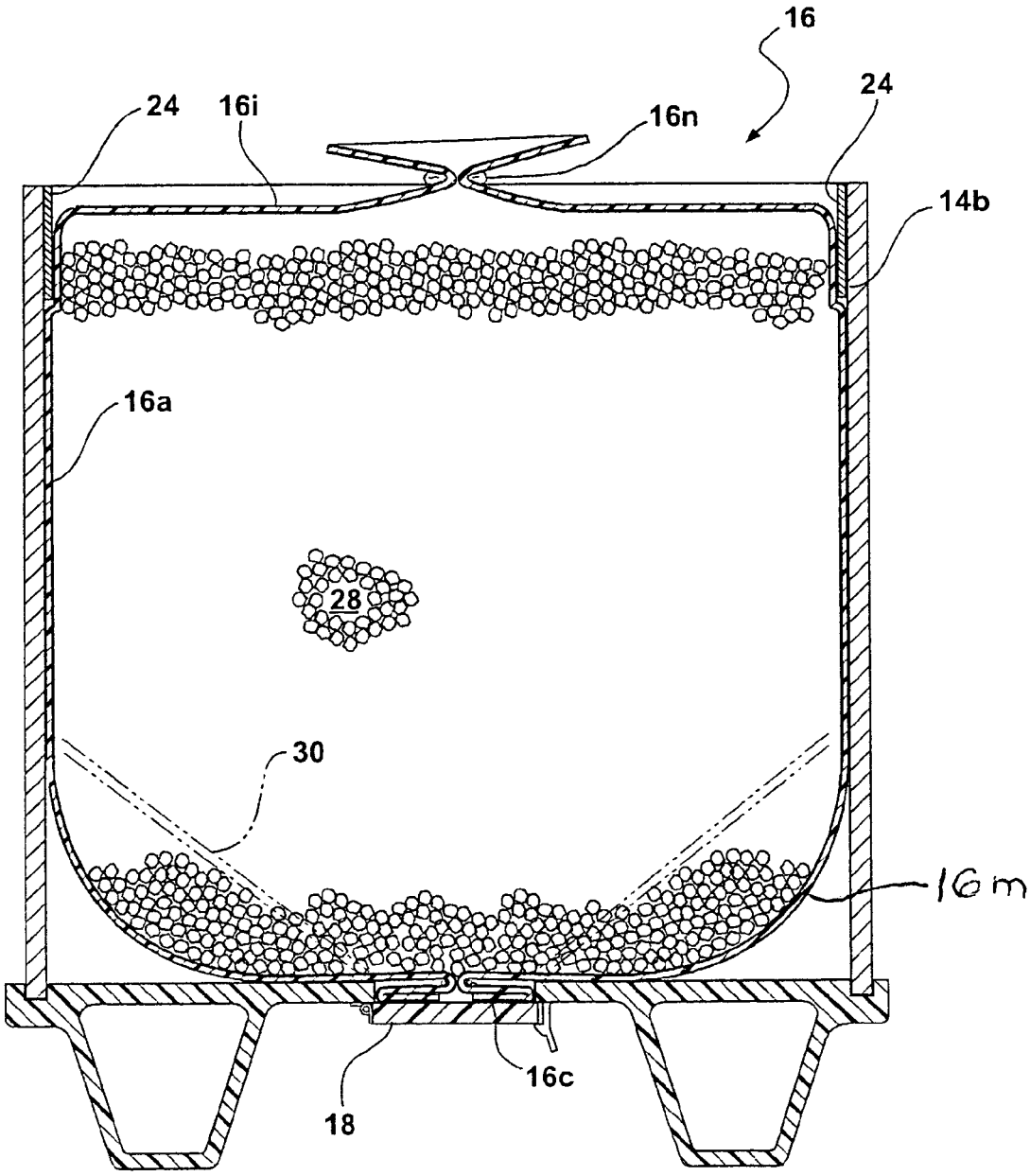

As seen in FIG. 6, a suitable fungible bulk material 28 is loaded into the container through loading spout 16*j* whereafter the loading spout is tied to form a knot configuration 16*n*. As the fungible material fills the liner, the lower portion 16*b* of the liner bulges outwardly and assumes a parabolic or catenary configuration seen at 16*m* in FIG. 6. Note that the parabolic liner portion 16*m* partially fills the annular void defined between the planar annular surface of the flat portion 12*a* in surrounding relation to the port 12*b*, the sleeve, and the lower portion of the liner with the liner in a relaxed configuration as seen in FIG. 4. This partial filling of the annular void is shown is FIG. 6 as the annular space between the bulging side 16*m* and the dash line 30.

Figure 7:
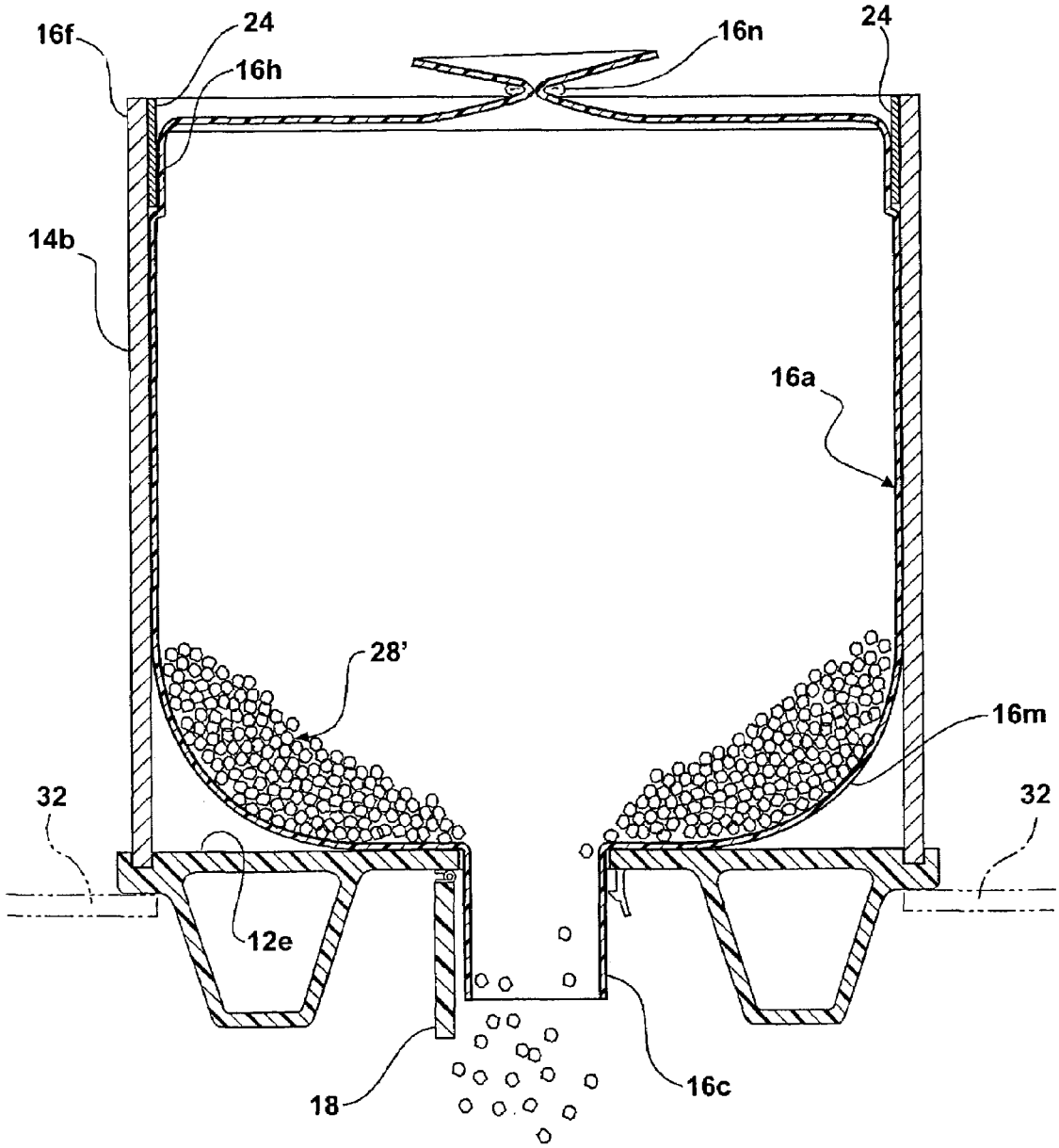
Figure 8:
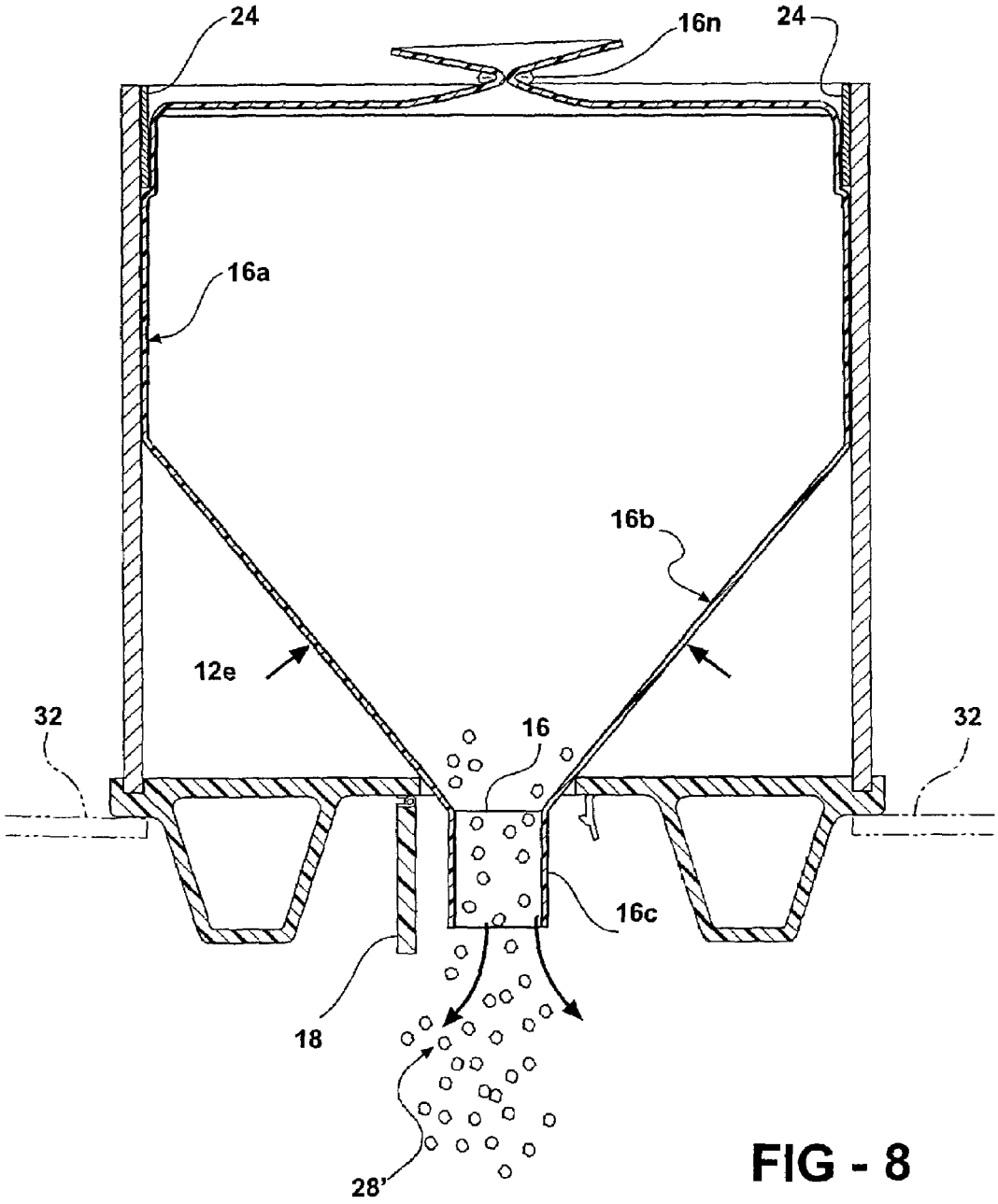

When it is desired to empty the contents of the container, and as seen in FIG. 7, the container is suitably elevated (utilizing, for example, a rack 32), the trap door 18 is moved to its open position, the tape or other means securing the discharge spout to the lower end of the liner is released to allow the discharge spout 16*c* to extend downwardly through the port 12*b*, and the contents 28 are allowed to discharge downwardly by gravity from the container through the spout 16*c*. Without any further action on the part of the operator, a small amount of residual material indicated at 28' would remain within the parabolic or bulge portion 16*m* of the lower portion of the liner. However, as seen in FIG. 8, even this last, residual portion can be readily removed from the container by pulling downwardly on the spout 16*c* to pull the liner downwardly through the port 12*b* and return the lower portion 16*b* to its relaxed conical or trapezoidal configuration. It will be seen that this downward tugging on the spout has the effect of creating a smooth conical sliding surface for the residual material 28' so that the material is readily discharged from the container through the spout. It will further be seen that this downwardly extending spout can be readily and selectively squeezed by an operator to provide a valving means to selectively and precisely control the discharge process.

Figure 11:
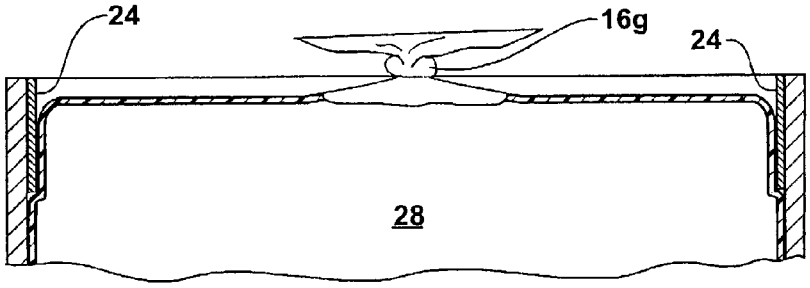
FIGS. 9, 10 and 11 illustrate an alternate liner configuration.
Figure 2:
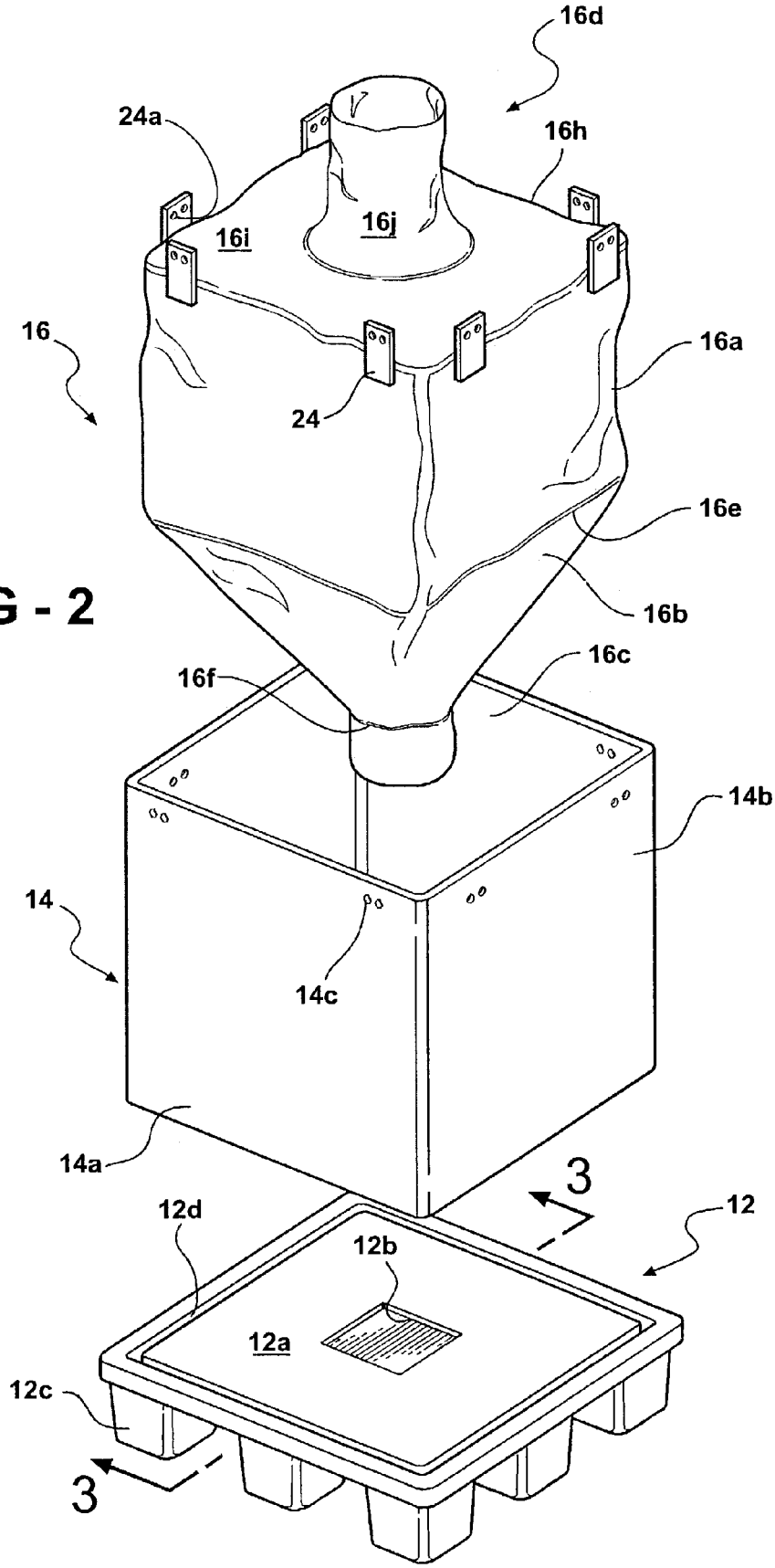
FIG. 2 is an exploded view of the container.
Figure 9:
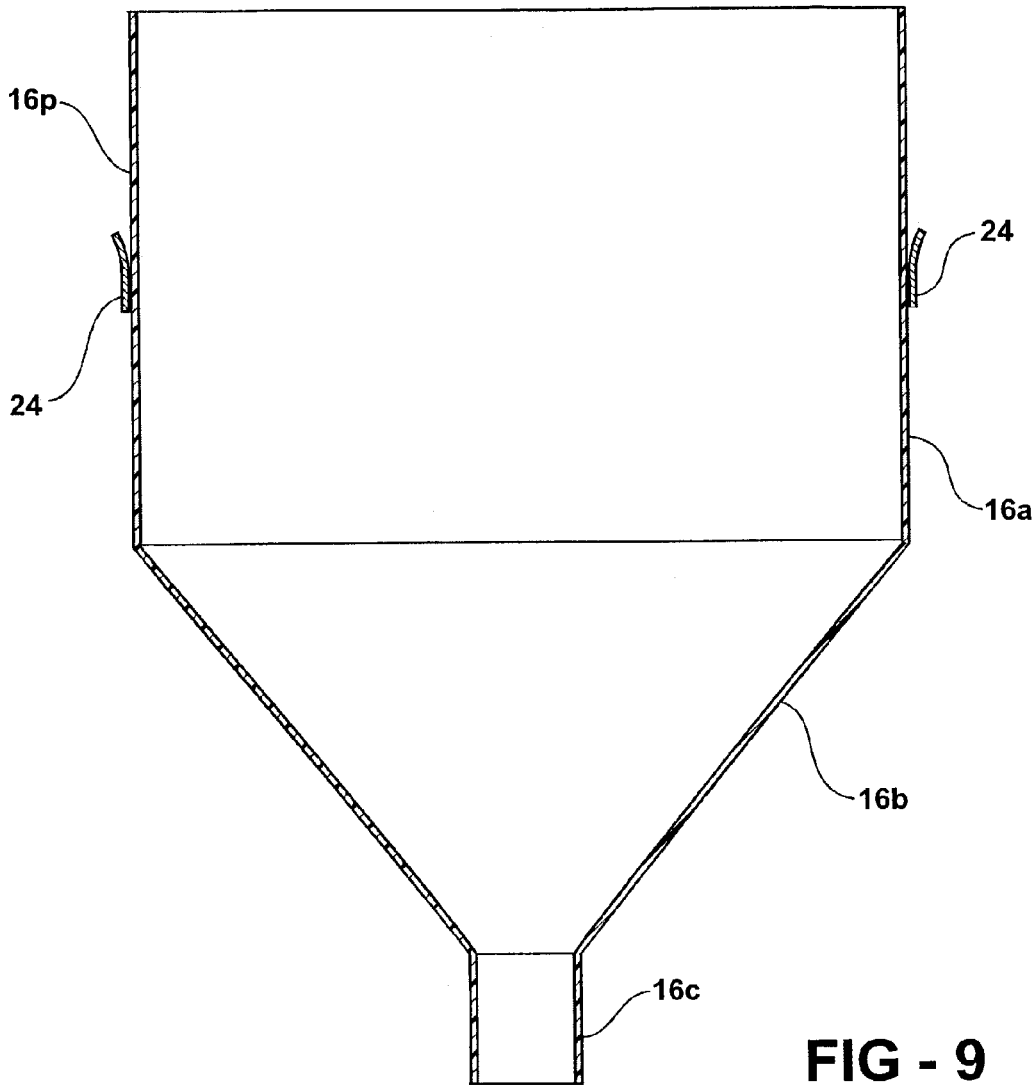
Figure 10:
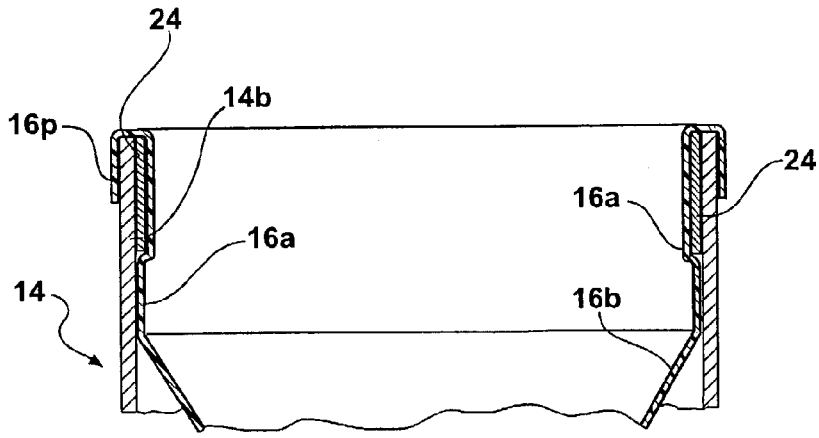

In the alternate liner configuration seen in FIG. 9, the loading portion 16*p* of the liner comprises an upward tubular extension of the upper liner portion 16*a*. The liner is otherwise identical to the liner of FIGS. 1–8. In the use of the liner of FIG. 9, and as seen in FIG. 10, the tabs 24 are secured to the inner sleeve periphery proximate the upper edge 14*b* of the sleeve utilizing strings 26 and holes 14*c*/24*a* whereafter top 16*p* is folded downwardly over and outside of the top of the sleeve. This arrangement provides a totally open top for the liner to facilitate mass production loading of the liner, whereafter top 16*b* may be tied as seen in FIG. 11 to form a knot 16*q*.

The invention will be seen to provide a bulk container wherein substantially all of the capacity of the container is utilized and wherein all of the contents of the container are readily discharged from the container.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A container including a pallet having a rigid, planar platform portion defining a central discharge port and a planar annular surface in surrounding relation to the discharge port, a tubular sleeve supported at a lower edge thereof on the pallet, and a flexible liner positioned within the sleeve, characterized in that:

the pallet includes a door selectively closing the central discharge port;

the liner includes an upper portion of uniform cross-sectional configuration conforming to the cross-sectional configuration of the sleeve and a lower portion of downwardly and inwardly tapering configuration terminating in a bottom liner opening positioned proximate the pallet discharge port; and the effective combined height of the upper and lower portions of the liner within the sleeve with the upper edge of the upper liner portions secured to the upper edge of the sleeve is greater than the distance from the upper edge of the sleeve to the upper face of the pallet proximate the discharge port whereby, with the door closed, the sides of the lower portion may bulge outwardly in response to the loading of contents into the liner to at least partially fill the annular void defined between the sleeve, the annular platform surface, and the lower portion of the liner with the liner fully extended.

2. A container according to claim 1 wherein the lower portion of the liner has a truncated conical configuration.

3. A liner according to claim 1 wherein the lower portion of the liner has a truncated pyramidal configuration.

4. A container according to claim 1 wherein the liner further includes a spout extending downwardly from the lower end of the lower portion for passage through the pallet discharge port.

5. A container according to claim 1 wherein the door comprises a trap door mounted on the pallet.

6. A sleeve and liner according to claim 1 wherein the sleeve has a rectangular configuration and is formed of a cardboard material.

7. A sleeve and liner according to claim 6 wherein the liner is formed of a flexible plastic material and the upper liner portion has a rectangular cross-sectional configuration.

8. A container including a rigid plastic pallet having a rigid planar platform portion defining a central discharge port and a planar annular surface in surrounding relation to the discharge port, a cardboard tubular sleeve supported at a lower edge thereof on the pallet, and a flexible plastic liner positioned within the sleeve and including an upper portion of uniform cross-sectional configuration conforming to the cross sectional configuration of the sleeve and a lower portion of downwardly and inwardly tapering configuration terminating in a bottom liner opening positioned proximate the pallet discharge port, the pallet having a trap door selectively closing the central discharge port, the effective combined height of the upper and lower portions of the liner within the sleeve with the upper edge of the upper liner portion secured to the upper edge of the sleeve being greater than the distance from the upper edge of the sleeve to the upper face of the pallet proximate the discharge port whereby, with the trap door closed, the sides of the lower portion may bulge outwardly in response to the loading of contents into the liner to at least partially fill the annular void defined between the sleeve, the annular platform surface, and the lower portion of the liner with the liner fully extended.

9. A container according to claim 8 wherein the liner further includes a spout extending downwardly from the lower end of the lower portion for passage through the pallet port.

10. A sleeve and liner according to claim 8 wherein the lower portion of the liner has a truncated conical configuration.

11. A sleeve and liner according to claim 8 wherein the lower portion of the liner has a truncated pyramidal configuration.

* * * * *